United States Patent [19]

Brooks

[11] 4,415,423

[45] Nov. 15, 1983

[54] ELECTROFORMING APPARATUS FOR USE IN MATRIXING OF RECORD MOLDING PARTS

[75] Inventor: William C. Brooks, Brownsburg, Ind.

[73] Assignee: RCA Corporation, New York, N.Y.

[21] Appl. No.: 416,241

[22] Filed: Sep. 9, 1982

[51] Int. Cl.[3] ..... C25D 1/10; C25D 21/10

[52] U.S. Cl. ..... 204/212; 204/5; 204/273; 204/276

[58] Field of Search ..... 204/5, 212, 273, 275, 204/276

[56] References Cited

U.S. PATENT DOCUMENTS

| | | | |
|---|---|---|---|
| 3,186,932 | 6/1965 | Gelfand | 204/216 |
| 4,269,669 | 5/1981 | Soby | 204/5 |
| 4,359,375 | 11/1982 | Smith | 204/275 |

FOREIGN PATENT DOCUMENTS

| | | | |
|---|---|---|---|
| 1503553 | 10/1967 | France | 204/5 |

*Primary Examiner*—T. M. Tufariello

*Attorney, Agent, or Firm*—Birgit E. Morris; Edward J. Sites

[57] ABSTRACT

In the apparatus of this invention, filtered electrolyte is introduced immediately adjacent to the revolving cathode head of the apparatus and the filtered electrolyte is forced to flow along the surface of the cathode head to the surface of the bath, thereby flushing foreign materials from the cathode head and the part being replicated. A side weir is provided which is positioned normal to the plane of rotation of the revolvable cathode head which assists in drawing the electrolyte contaminated with foreign materials away from the electroforming section so that the contaminated electrolyte can be more effectively filtered and reused.

4 Claims, 2 Drawing Figures

ELECTROFORMING APPARATUS FOR USE IN MATRIXING OF RECORD MOLDING PARTS

This invention relates to an electroforming apparatus for use in matrixing of record molding parts and more particularly is concerned with an electroforming tank having improved electrolyte flow properties.

BACKGROUND OF THE INVENTION

In the manufacture of molded records, such as conventional audio records or the more recently developed video discs, electroforming is used in a series of critical process steps. In the manufacture of video discs, for example, the program information is cut into a metal recording substrate which is made by electroforming a relatively thick layer of metal, such as bright acid copper, on a rigid support. After the desired program information has been cut into the recording substrate the substrate is replicated by electroforming a metal on the surface of the recording substrate to produce a matrix part referred to as a master. The master in turn is replicated by electroforming a metal on its surface to form on or more matrix parts which are referred to as molds. The molds in turn are replicated by electroforming a metal, typically nickel, on the surface of the molds to produce matrix parts referred to as stampers. The stampers, if properly made, will be exact negative replicas of the recorded substrate. The stampers are the matrix parts which are actually used to mold the plastic records.

If the series of electroforming replication steps noted above are carried out correctly, the audio records or the video discs which are pressed with the stampers will, on playback, produce a high fidelity reproduction of the program information which was cut into the recording substrate. If has been found, however, that in the electroforming process defects are often introduced into the replicas. The defects are typically small pits or voids but also include embedded particles. The formation of defects in matrix parts during electroforming is additive in nature in that the defects introduced in each electroforming step are replicated in each subsequent part. For example, defects in the recording substrate are reproduced in the master, mold, stampers and finally in the molded records pressed with the stampers. In a like manner, defects formed in the master are added to the defects from the recording substrate and reproduced in the molds and so forth.

The defects which occur in the matrixing process are typically relatively small by conventional standards, being on the order of a micron to a few microns in size and accordingly are called "microdefects". Microdefects, despite their name, are a major concern in the manufacture of records in general and particularly in the manufacture of video discs. In a video disc the signal tracks are only about 4,000 angstroms deep and the signal elements are only about 500 to 1000 angstroms in amplitude. Furthermore, the signal information tracks are only about 2.7 microns wide and are spaced about 4,000 per centimeter across the recorded surface of the video disc. Therefore, a microdefect in an electroformed part for video disc molding which is a few microns in diameter or only a micron or so in depth can constitute a major defect in the video disc because of the relatively small size of the topographical features molded into the discs. Microdefects can cause the recorded program information to be grossly distorted or even cause a complete loss of picture and sound on playback of a video disc. Further common problems caused by microdefects includes "locked groove" wherein the video discs continue to repeat a particular segment of the recorded program and "skipped grooves" wherein the stylus of the video disc player skips over a series of grooves, causing discontinuities in the recorded program information. The microdefects can also cause excessive wear and even breakage of the diamond styli used in the video disc players.

The microdefects which are produced in the electroformed parts are to a large extent caused by foreign materials in the electrolyte used in the electroforming process. The foreign materials are introduced in the electrolyte from many different sources such as from the metal supplied to the anodes, from the parts that are to be electroformed, produced by chemical breakdown of the electroforming solutions and so forth. The foreign materials found in the electrolyte can be present as liquids or solids. Solid particles if they are present can become embedded into the electroformed matrix part, causing either a hard spot or a soft spot in the final part, both of which cause substantial problems especially in the recording substrates. Liquids such as oils and the like can effectively prevent metal deposition in a given area, causing a void or pit to form in the electroformed parts which results in a pit or bump in the molded record, depending upon the particular step in the matrixing process where the defect occurs.

Various methods have heretofore been used to remove foreign materials from the electroforming solutions. One such method is to circulate and filter the solution during electroforming to remove foreign materials. However, one of the problems which has been encountered in circulating and filtering of the electrolyte is that in the conventional electroforming tanks, heretofore used in matrixing of parts for record part, the foreign materials, instead of being removed from the tank for filtering, tend to accumulate in the electrolyte and particularly to accumulate immediately adjacent to the part being replicated. The accumulation of foreign materials immediately adjacent to the part being electroformed is partly caused by poor circulation and because the flow patterns in many of the prior art electroforming tanks causes the revolving cathode head acting as a dam against which the foreign particles tend to collect. It has been suggested in the prior art to use a stand pipe or the like to remove the electrolyte for the purposes of filtering it, but this at best has only a localized effect and does not remove the accumulated foreign materials from the surface of the cathode. It has also been suggested to use bottom drains to remove the electrolyte, but this allows floating foreign materials to accumulate on the surface of the electrolyte bath which continue to cause problems in the electroforming process.

A highly advantageous electroforming apparatus for use in the matrixing of electroformed parts for record manufacture would have characteristics that would eliminate or substantially reduce the formation of microdefects in the electroformed matrix parts.

SUMMARY OF THE INVENTION

In the apparatus of this invention, filtered electrolyte is introduced immediately adjacent to the revolving cathode head of the apparatus and the filtered electrolyte is forced to flow along the surface of the cathode head to the surface of the bath, thereby flushing foreign materials from the cathode head and the part being replicated. A side weir is provided which is positioned normal to the plane of rotation of the revolvable cathode head which assists in drawing the electrolyte contaminated with foreign materials away from the electroforming section so that the contaminated electrolyte can be more effectively filtered and reused.

DETAILED DESCRIPTION OF THE INVENTION

Figure 1:
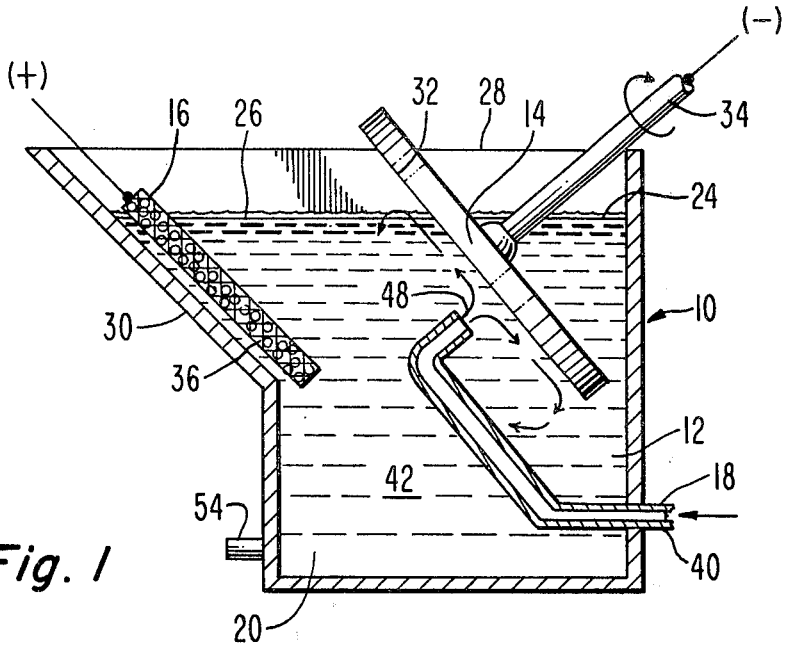
FIG. 1 is a cross-section illustration of the electroforming apparatus of this invention.
Figure 2:
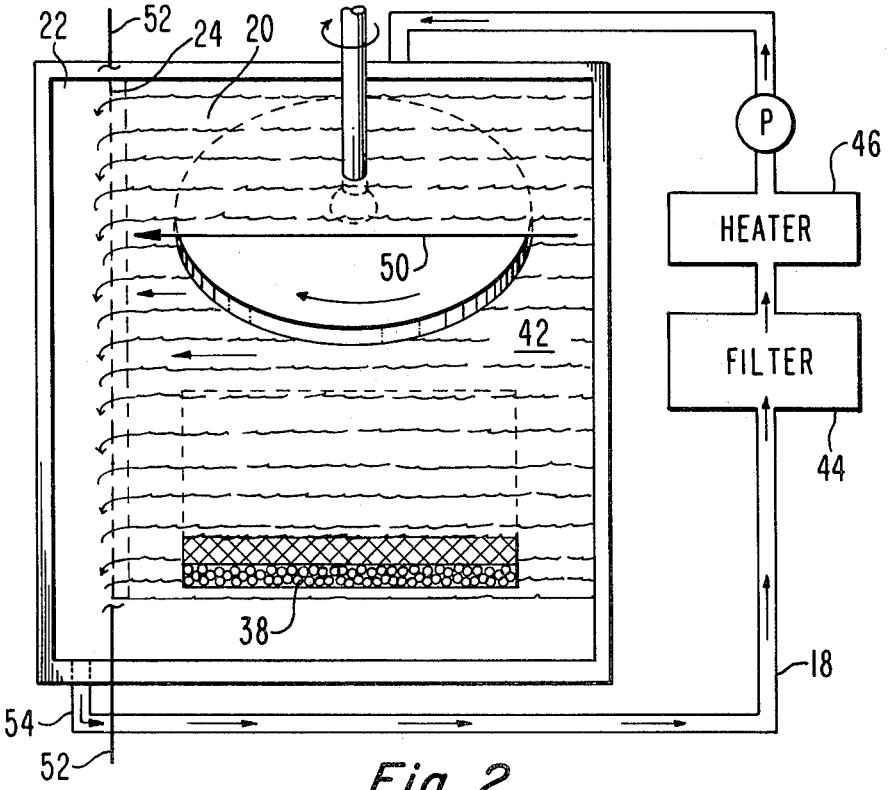
FIG. 2 is a top plan view of the electroforming apparatus of this invention shown with an associated filter and heater apparatus.

The electroforming apparatus 10 of this invention is comprised of a tank 12, a revolvable cathode 14 and anode 16 and electrolyte supply means 18.

The tank 12 is comprised of an electroforming section 20 and a sump section 22. Positioned between the electroforming section 20 and the sump section 22 is a weir 24. The weir 24 has an upper edge 26 which is lower than the upper edge 28 of the tank 12.

The tank 12 can be constructed of various materials which will withstand the conditions encountered in electroforming. A suitable material for the tank is, for example, stainless steel coated with a continuous impervious layer of polyvinyl chloride.

The exact configuration of the tank is not critical. As shown, the tank has a sloping forward wall 30 to support the anode 16 in a substantially parallel relationship to the angle of entry of the revolving head cathode 14 into the bath. The cathode 14 enters the electroforming section 20 over the edge of the tank at an anode in order to avoid a through the wall liquid tight type seal for the revolving cathode 14. It should be appreciated that the disclosed configuration shown in the drawing for the tank 12 is only given by way of illustration and that other configurations can likewise be used in accordance with the teachings of this invention.

The revolving cathode head 14 consists of a disc shaped mounting head 32 on which the part which is to be duplicated (not shown) is secured in an electrical contact with the cathode drive 34.

The anode 16 is of conventional design and consists of a titanium basket 36 into which pellets 38 of the metal which is to be electroformed on the part held on the mounting head 32 are placed.

The electrolyte supply means 18 consists of an inlet pipe 40 through which filtered electrolyte 42 is pumped from the filter 44 and the heater 46. The inlet pipe 40 extends through the interior of the electroforming section 20 of the tank 12 to an outlet 48 which is immediately adjacent to the surface of the revolving cathode head 32. The distance of the outlet 48 from the surface of the mounting head has been found to be preferably about 5 to 15 centimeters. The flow of electrolyte from the outlet 48 is focused directly on the surface of the mounting head 32 so that when the filtered electrolyte 42 is pumped from the outlet 48 it will sweep across the surface of the mounting head 32 to provide a fresh supply of filtered electrolyte immediately adjacent the mounting head 32.

The weir 24 of the tank 12 is positioned in a plane 52 which is substantially normal to the plane of rotation 50 of the mounting head 32. As illustrated, the mounting head 32 of the cathode 14 is positioned at an angle to the surface of the electrolyte 42 in the electroforming section 20, but it should be noted that it is still normal to the weir 24 so that when the electrolyte 42 flows across the electroforming section 20 the flow will be parallel to the direction of rotation of the revolving mounting head 32 and will be normal to the weir 24.

A drain 54 is provided at the base of the sump section 22. A drain 54 is connected to the filter 44 which in turn is connected to the heater 46 and then to the inlet pipe 40 so that the material from the sump can be filtered and treated prior to introduction into the electroforming section 20 of the apparatus 10 of this invention.

In use the electroplating apparatus of this invention 10 is used in many respects in the same manner as the conventional electroforming apparatus heretofore employed in the prior art. Pellets 38 of the metal to be electroformed to form the part on the cathode head 32 are loaded into anode baskets 36. The same type of electrolyte 42 which are employed in the prior art apparatus can likewise be employed using the apparatus of the present invention 10. In addition, the same electroforming current conditions can likewise be employed.

The difference in operation, however, of the apparatus of this invention 10 is primarily related to the flow of the electrolyte 42 during the electroforming operation. In the start up of the apparatus 10 a flow of electrolyte 42 is established through the tank 12. The flow rate is established and maintained in an amount sufficient to have a substantial flow of electrolyte 42 over the weir 24 during electroforming. The flow rate should be sufficient to effectively establish a strong current across the surface of the electrolyte 42 in the electroforming section 20 of the tank sufficient to remove the foreign material from the electroforming section 20. The flow of the electrolyte 42 is likewise preferably maintained at a sufficient rate through the outlet 46 to cause the electrolyte 42 to flow upward and across the surface of the rotating cathode head and to exit at the surface of the electrolyte bath so as to cause a turbulence away from the rotating cathode head 22. The outward turbulence will carry away the foreign materials from the surface of the mounting head 32 and force the foreign materials into the current created by the flow of the electrolyte 42 over the weir 24. The mounting head 32 preferably is rotated towards the weir 24 so as to further provide a pumping action to direct the electrolyte 42 and the impurities over the weir 24 into the sump section 22. The contaminated electrolyte 42 which enters the sump 22 is then circulated to the filter 44, wherein the foreign materials are removed and the purified material is sent to the heater 46 where the temperature is adjusted to a predetermined level. The filtered electrolyte is then recirculated to the inlet pipe 40 and to the outlet nozzle 48 as noted above.

It has been found that the combination of introducing the cleaned filtered electrolyte 42 adjacent the face of the revolving cathode 32, and at a sufficient force to cause outward turbulence at the surface of the electrolyte, forces the fluctuating foreign materials away from the revolving cathode head 32 and the part which is being replicated, whereby microdefects are substantially reduced or eliminated in the electroformed parts. Furthermore, the flow established over the weir 24 and the current caused thereby within the electroforming section 20 draws the foreign materials in a direction which is normal to the plane of rotation of the revolving cathode head, thereby further eliminating the possibility of inclusion of the foreign materials into the electroformed parts formed of the revolving cathode head 32. Using the apparatus of this invention 10, it has been found that the electroformed replicas, be they masters, molds or stampers, have been found to be significantly more free of microdefects of the type heretofore associated with foreign particles in electroforming and accordingly higher quality records are obtained from the stampers produced using the apparatus of the present invention.

What is claimed is:

1. An electroforming apparatus comprising in combination: a tank, a cathode, an anode, and means for circulating electrolyte; said tank having an electroforming section, a sump section and a weir separating said sections, said electroforming section able to hold a supply of electrolyte sufficient to permit the electroforming of said parts, said weir being positioned across an edge wall of the electroforming section so as to permit an overflow of electrolyte from the electroforming section into the sump section during the process of electroforming; said cathode including a revolvable disc shaped cathode head having means for securing a part to be replicated in position on the face of the cathode so that a replica can be electroformed on the part, said cathode head being positionable in the electroforming tank so as to at least be partially submerged in the electrolyte when the electroforming section is filled with an electrolyte, said cathode head being revolvable in a plane which is substantially normal to the overflow direction of the weir; said anode being positioned in said electroforming section in an opposing relationship to the cathode; said means for circulating electrolyte including inlet means for introducing electrolyte adjacent to the cathode head so as to induce a flow of electrolyte across the surface of a part mounted on the cathode head which is to be replicated and said circulating means further including means for removing electrolyte from the sump section and filtering and recirculating the electrolyte to said inlet means.

2. The apparatus according to claim 1 wherein the cathode is revolving in a direction towards the weir thereby further inducing a flow of the electrolyte over the weir.

3. The apparatus according to claim 1 wherein the inlet means is adapted to provide a force of electrolyte sufficient to cause an outward turbulence away from the cathode head at the surface of the electrolyte in said electroforming section thereby forcing away foreign materials from the surface of the part to be replicated.

4. The apparatus according to claim 1 which further includes heater means in the electrolyte circulation means.

* * * * *

UNITED STATES PATENT AND TRADEMARK OFFICE
CERTIFICATE OF CORRECTION

PATENT NO. : 4,415,423

DATED : November 15, 1983

INVENTOR(S) : William Clark Brooks

It is certified that error appears in the above-identified patent and that said Letters Patent is hereby corrected as shown below:

Column 1, line 37, "If" should read --It--.

Column 4, line 60, "fluctuating" should read --floating--.

Signed and Sealed this

*Seventh* Day of *February 1984*

[SEAL]

*Attest:*

GERALD J. MOSSINGHOFF

*Attesting Officer*

*Commissioner of Patents and Trademarks*